United States Patent [19]

Walsh

[11] 4,149,724

[45] Apr. 17, 1979

[54] BAT AND STICK GAME

[76] Inventor: Sylvia M. V. Walsh, 1497 Via Manzanas, San Lorenzo, Calif. 94580

[21] Appl. No.: 801,515

[22] Filed: May 31, 1977

[51] Int. Cl.[2] ..... A63B 67/00

[52] U.S. Cl. ..... 273/95 F

[58] Field of Search ..... 273/95 F, 106 R

[56] References Cited

U.S. PATENT DOCUMENTS

| | | | |
|---|---|---|---|
| 1,935,370 | 11/1934 | Nekuda | 273/95 F |
| 2,993,696 | 7/1961 | Demaline | 273/95 F |
| 3,232,618 | 2/1966 | Anderson | 273/95 F |
| 4,052,065 | 10/1977 | Rodriguez | 273/95 F |

*Primary Examiner*—William H. Grieb

*Attorney, Agent, or Firm*—Bielen and Peterson

[57] ABSTRACT

An improvement in the bat and stick game known commonly as "cat and dog" wherein an elongated staff comprising a bat and a thin relatively short baton comprising a stick which is struck by the bat first to twirl it vertically into the air and again to propel it horizontally, the improvement comprising a contoured stand to elevate the baton a relatively short distance above the ground and enable the game to be played on a surface other than hard surfaces such as pavement.

5 Claims, 5 Drawing Figures

BAT AND STICK GAME

BACKGROUND OF THE INVENTION

This invention relates to a bat and stick game commonly called cat and dog and in particular to a device used in combination with the bat and stick to enable the game to be played on a variety of playing surfaces.

In the game "cat and dog", a relatively short stick or "cat" with at least one pointed end is struck on the pointed end while resting horizontally on the ground. The struck stick twirls vertically into the air which enables the stick to be struck again by the bat to propel the stick a distance horizontally. Conventionally the distance traveled is the measure of accomplishment, with the number of misses and other such criteria contributing to local rule variations.

Because the pointed or conical end of the stick is used to fulcrum the stick into the air when struck, the game must be performed on a relatively hard surface such as pavement or hard dirt. It is difficult to play the game on relatively soft surfaces such as grass lawns or sand. Furthermore, the pointed end of the stick is unnecessarily dangerous when propelled, often erratically, a considerable distance when struck by the bat. Because of such factors, an improved bat and stick game has been devised which can be played safely in any open area.

SUMMARY OF THE INVENTION

The bat and stick game devised and described herein comprises a bat, a stick and a tee support for the stick. The game, historically called "cat and dog" requires the stick to be struck such that it twirls vertically in the air in order that it can be again stuck by the bat for distance as described above. Because a hard surface must be customarily used for the first striking of the stick, the game is limited in its environment of use and was primarily a street game. Since the stick was also required to be pointed the game was more hazardous than necessary. The tee support devised, enables a blunt end stick to be supported on any generally flat surface without regard to composition of the surface. The tee support includes a base, an elevating portion and a support cradle on which the stick or baton is supported at an incline with at least one end projecting from the cradle for striking with the bat or staff. The baton preferably has blunt ends and is relatively light weight for safety.

DETAILED DESCRIPTION OF THE PREFERRED EMBODIMENTS

Figure 1:
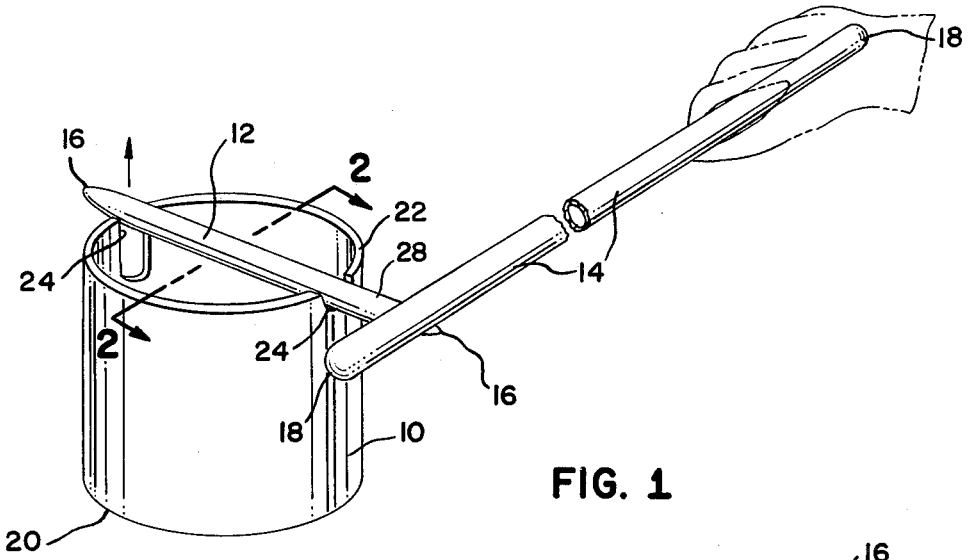
FIG. 1 is a perspective view of the combination bat and stick game.

Referring to FIG. 1, the three members of the newly devised bat and stick game are shown perspectively in utilitarian combination with a tee support 10, used for supporting a stick or baton 12 which is being struck with a hand-held elongated bat or staff 14.

The baton 12 is preferably constructed of a hollow, relatively light, plastic of the styrene polmer for strength and durability. The ends 16 of the baton are blunted, which coupled with a light weight make the preferred embodiment particularly safe to use. The baton may also be more conventionally constructed of wood, for example, ash, which is less desirable from the safety consideration, but is more suitable for older, more experienced and serious players.

Similarly, the staff 14 is preferably fabricated from a hollow plastic material with rounded ends 18, but may be alternately constructed from a hardwood such as ash. The staff 14 is considerably larger than the baton 12 and is preferably a broom handle size, about three feet long and an inch in diameter. Preferably, the baton is approximately four to ten inches long and three quarter inch in diameter. Such dimensions are not critical and may vary somewhat arbitrarily as to convenience of use as well as with the nature of the materials utilized in their fabrication.

The tee support 10 in the principal embodiment comprises a cylindrically shaped stand about three inches in diameter and two inches in height. The stand may be solid, but preferably as shown in FIG. 1 comprises a tube or ring having a flat annular base 20 with a top 22 with two opposed, notches, one substantially lower than the other forming a cradle for the angled support of the baton 12. The body 26 of the tube segment comprises an elevating portion of the tee support for raising the supported baton in the cradle above a ground surface on which the base 20 rests. Again the tee support may be fabricated from plastic, wood or other suitable material.

Figure 2:
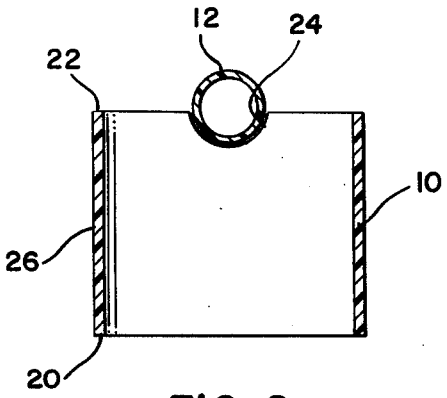
FIG. 2 is a cross sectional view of the baton and tee support taken on the lines 2—2 in FIG. 1.
Figure 3:
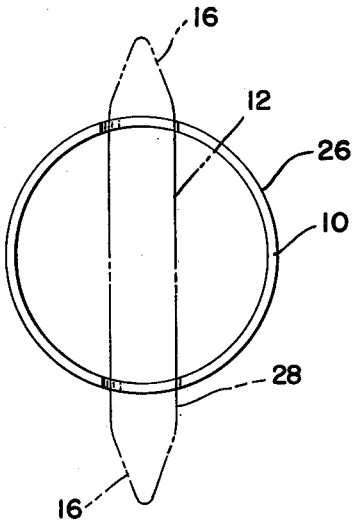
FIG. 3 is a plan view of the tee support of FIG. 1.

The configuration of the cradle notches 24 with respect to the body 26 of the tube segment and the baton 12 is most clearly illustrated in FIGS. 2 and 3. The semicircular notches are diametrically aligned to provide a stable two point support for the baton. The baton 12, shown in phantom in FIG. 3, is preferably positioned such that the higher end portion 28 projects a substantial distance away from the top lip 30 of the tee support 10. It is this projecting end portion 28 which is struck by the staff 14, shown in FIG. 1, to cause the baton to twirl vertically upward for a second striking to propel the baton for distance.

Figure 4:
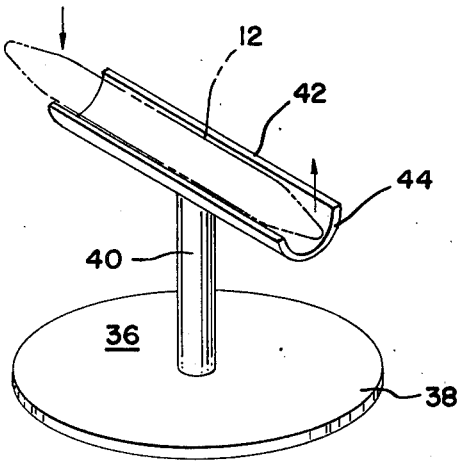
FIG. 4 is a perspective view of an alternate embodiment of the tee support.
Figure 5:
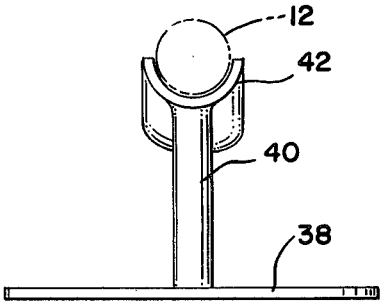
FIG. 5 is a side elevational view of the tee support of FIG. 4.

Referring to FIGS. 4 and 5, an alternate embodiment of the tee support is shown. The tee support 36 illustrated therein comprises a circular disk-like base 38, a rod-like elevating neck portion 40 and an elongated, channel-like top cradle 42 of semicircular configuration for supporting the baton 12. While aesthetically more appealing than the embodiment previously described, the tee support shown in FIGS. 4 and 5 is more difficult and expensive to fabricate ideally requiring an expensive injection molding process for a one piece construction.

Alternately, the support tee shown could be constructed from three separate elements: a flat circular disk for the base 38, a cylindrical rod for the neck portion 40 and a longitudinal half of a tube section for the cradle 42 on which is supported the baton 12 shown in phantom. Again the baton is supported with at least one end projecting from the edge 44 of the cradle to allow for striking.

The cradle 42 is inclined such that the baton 12 is supported at an angle as in the previous embodiment. In this manner the baton will more regularly rise vertically than if horizontally supported.

While in the foregoing specification embodiments of the invention have been set forth in considerable detail for purposes of making a complete disclosure of the invention, it will be apparent to those skilled in the art that numerous changes may be made in such details without departing from the spirit and principles of the invention.

What is claimed is:

1. An improved bat and stick game comprising in combination:

an elongated staff element comprising a bat, a relatively short baton with opposed end segments comprising a stick adapted to be struck by the bat, and, a support tee having a base, a fixed support cradle with a first end portion and a second end portion elevated above said first end portion adapted and constructed to support said baton in an inclined and elevated position with an end segment of said baton extending beyond said support cradle, and means for elevating said cradle above said base, said means comprising a stationary stand between said base and said cradle with each end portion of said cradle elevated above said base, said stand constructed with relation to said cradle wherein said baton is supportable with at least one end segment of said baton selectably extendable beyond each end portion of said cradle for striking of such extended end segment of said baton by said bat.

2. The bat and stick game of claim 1 wherein said support tee comprises a cylindrical stand of uniform annular cross section with a circular top and a bottom, said support cradle being formed by a first notch and a second notch in the circular top of said cylindrical stand, said first and second notches comprising respectively, said first end portion and said second end portion of said cradle.

3. The bat and stick game of claim 2 wherein said cradle has a cross section for support of said baton of generally semicircular configuration.

4. The bat and stick game of claim 1 wherein said support tee comprises a cylindrical stand having a solid body portion with a flat bottom comprising both said base and said means for elevating said cradle above said base, and a top with a groove for supporting the baton comprising said cradle.

5. The bat and stick game of claim 1 wherein said base of said support tee comprises a flat disk, said cradle comprises an elongated channel, and said stand comprises a neck element having a first end connected to said disk and a second end connected to said channel.

* * * * *